United States Patent [19]

King

[11] Patent Number: 4,685,395

[45] Date of Patent: Aug. 11, 1987

[54] CONTROLLED INDUCTIVE COUPLING DEVICE

[75] Inventor: Alan G. King, Dundonald, Scotland

[73] Assignee: Imperial Chemical Industries PLC, London, England

[21] Appl. No.: 708,054

[22] Filed: Mar. 4, 1985

[30] Foreign Application Priority Data

Apr. 25, 1984 [GB] United Kingdom ..... 8410518

[51] Int. Cl.[4] ..... F42C 15/40; F42B 3/18; F42D 5/00

[52] U.S. Cl. ..... 102/202.2; 102/200; 323/330

[58] Field of Search ..... 102/200, 202.1, 202.2, 102/206, 209, 217; 323/330, 329; 336/160, 133, 110, 30

[56] References Cited

U.S. PATENT DOCUMENTS

| | | | |
|---|---|---|---|
| 2,854,591 | 9/1958 | Immel et al. | 323/330 |
| 2,933,653 | 4/1960 | Carter | 102/209 |
| 3,123,002 | 3/1964 | Spool | 102/209 |
| 3,671,810 | 6/1972 | Barnes et al. | 323/330 |
| 4,297,947 | 11/1981 | Jones et al. | 102/206 |

FOREIGN PATENT DOCUMENTS

| | | | |
|---|---|---|---|
| 706015 | 3/1965 | Canada | 323/330 |
| 974760 | 11/1964 | United Kingdom . | |
| 1327235 | 8/1973 | United Kingdom . | |
| 2022222 | 12/1979 | United Kingdom . | |
| 2075272A | 11/1981 | United Kingdom . | |
| 1603386 | 11/1981 | United Kingdom . | |
| 2109512 | 6/1983 | United Kingdom . | |
| 2123217 | 1/1984 | United Kingdom | 102/209 |

*Primary Examiner*—Charles T. Jordan

*Attorney, Agent, or Firm*—Cushman, Darby & Cushman

[57] ABSTRACT

An inductive coupling device is provided wherein the transmission of energy through the device is controlled by the application of a steady magnetic field within the magnetically permeable core of the device, transmission being inhibited at high magnetic field intensity and restored when the magnetic field intensity is reduced to a low value. The device is especially advantageous for the safe coupling of ignition elements, such as blasting detonators, to an a.c. firing energy source.

12 Claims, 5 Drawing Figures

CONTROLLED INDUCTIVE COUPLING DEVICE

This invention relates to a controlled inductive coupling device wherein the capability of the device to transmit electrical energy from a primary circuit to a secondary circuit inductively linked to said primary circuit can be controlled. The invention also includes a method of controlling the transmission of electrical energy from a primary circuit to a secondary circuit inductively coupled thereto. The invention is especially advantageous when applied to control the transmission of firing energy from an electrical source, such as a blasting machine, inductively linked to the electrical firing circuit of an ignition element, for example, the electric fusehead of an electrical detonator.

Electric detonator assemblies adapted for inductive coupling to an electrical firing energy source are marketed widely by Nobel's Explosive Company Limited under the Registered Trade Mark "Magnadet", the blasting system using such detonators being generally described as the "Magnadet" system. In this blasting system an encased resistive ignition element of an electric detonator for detonating the blasting charge has its two terminals connected respectively to the ends of a continuous conductor wire which extends outside the detonator casing. The external portion of the conductor wire is fully insulated and is wound as a secondary winding of 3–5 turns on a ferrite ring core, which is usually termed a toroid (although it is generally a flat cylindrical section of a tube and it may have shapes other than circular, such as rectangular or multi-angular). For firing the detonator an insulated conductor wire is threaded as a single loop primary winding through one or more toroid ring cores and connected to a suitable source of A.C. firing current. These inductively coupled detonators are described in United Kingdom Patent Specifications Nos. 2022222A and 2109512A.

Inductively coupled "Magnadet" detonators are advantageous in many blasting operations because of their convenience in connecting for use and their high degree of safety from premature ignition by stray electric currents and static electricity. The inductive coupling can be designed to be frequency selective so that signals outside a designed band within a range of about 10 to 100 kHz will be effectively attenuated to prevent them firing the ignition element. Thus in general such detonators are designed to pass efficiently a signal of 10–20 kHz and in use are used with a blasting machine (exploder) generating a currency within this frequency band. The safety characteristics therefore ensure safety from all the common sources of dangerous electric currents. However the detonators are necessarily not protected against a spurious signal having a frequency within the designed frequency band and are therefore at some risk from such a signal when the primary conductor wire is in position in the toroidal core and especially when the primary wire is connected to the firing source. Since it is often necessary to position explosive charges and "Magnadet" detonators in shotholes for a considerable period of time before blasting and, moreover, the primary wire is connected to the firing source for some time before blasting, it would be advantageous if the detonators were completely safe from all currents until the time for firing.

It is an object of this invention to provide an inductive coupling device whose current transmitting capability can be controlled in order to prevent currents above a predetermined value being transmitted through the device. A further object is to provide an inductive device for connecting an A.C. firing source to an electric ignition element wherein the current transmitting capability of the device can be controlled so as to maintain the transmitted current below the firing current until firing of the ignition element is desired.

In accordance with the invention an inductive coupling device for coupling a primary circuit to a secondary circuit, comprises a magnetically permeable core to which each of said circuits may be inductively coupled, and means to apply a steady magnetic field within at least a portion of the said core, the intensity of the said magnetic field within said core being variable to effect control of the transmission of electrical energy from the primary to the secondary circuit.

The means to apply the magnetic field may comprise one or more magnets, preferably permanent magnets. The magnet(s) may advantageously be movable with respect to the said core to vary the field intensity. With such an arrangement the magnetic field can be maintained within the magnetically permeable core until the transmission of current is required and then reduced or removed by relative movement of the magnet and core.

The said permanent magnet advantageously has its poles disposed so that they may both simultaneously be in close proximity to the magnetically permeable core.

The means to apply the magnetic field should preferably be capable of magnetically saturating the magnetically permeable core, thereby rendering the device incapable of passing any significant current when the magnetic field is applied within the core.

The magnetically permeable core is advantageously a ferrite core and is preferably a ring core, hereinafter termed a toroidal core or toroid.

In using the coupling device of the invention at least one of said primary and secondary circuits is coupled as a winding of at least one turn through a magnetically permeable ring core and the primary circuit is connected to an A.C. source. When the core is a toroidal core at least one of said circuits may be coupled as a single strand of wire threaded through the said toroid. When the magnetic field intensity within the core is at a high value the transmission of electrical energy from the primary to the secondary circuit is inhibited but as the field intensity is reduced the energy transmission increases.

For firing an ignition element with the device, the primary circuit has an input connected to an A.C. firing source and the secondary circuit has an output connected to at least one ignition element. The primary circuit may be a single-strand closed loop threaded through one or several toroidial cores each core being inductively coupled to at least one secondary winding in series with the ignition element.

The invention also includes a method of controlling the transmission of electrical energy from a primary circuit to a secondary circuit, the circuits being inductively coupled to a magnetically permeable core, in which method a steady magnetic field is applied within at least a portion of the core when suppression of energy transmission is desired and the magnetic field is reduced when energy transmission is desired. The magnetic field is advantageously applied by a magnet which is movable with respect to the core and when energy transmission is desired the magnet is moved from a position in which the core lies within the magnetic field of said magnet to a position in which the core is effectively outside said magnetic field.

The method may advantageously be used as a method of arming an ignition element wherein the primary circuit is an A.C. firing circuit and the secondary circuit includes at least one ignition element, the ignition element(s) being maintained in a safe condition by the application of the magnetic field until firing of the element(s) is required and then armed by reduction or removal of the magnetic field to permit subsequent ignition of the element when A.C. energy is passed through the primary circuit.

The invention is further illustrated by the preferred embodiment which is hereinafter described, by way of example, with reference to the accompanying drawings wherein, FIG. 1 shows diagrammatically an inductively (transformer) coupled electric detonator firing circuit assembly.

Figure 1:
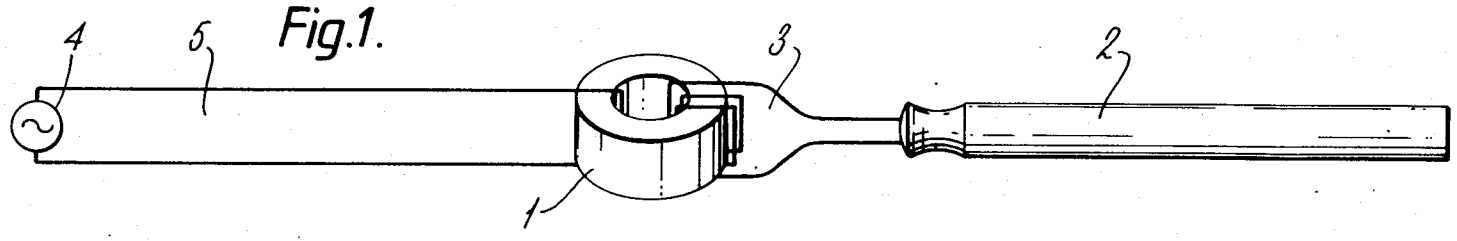

The assembly of FIG. 1 is a "Magnadet" electric detonator firing circuit comprising a ferrite toroid 1 to which an electric detonator 2 is coupled by a secondary circuit 3 and an A.C. generator 4 is coupled by a primary circuit 5. The secondary circuit 3 comprises three turns of insulated wire around the core 1 and the primary circuit 5 comprises a single loop of insulated wire through the toroid 1. In normal use the detonator is fired by generating firing current in the generator 4 at a frequency within the range which the toroid is designed to transmit effectively.

Figure 2:
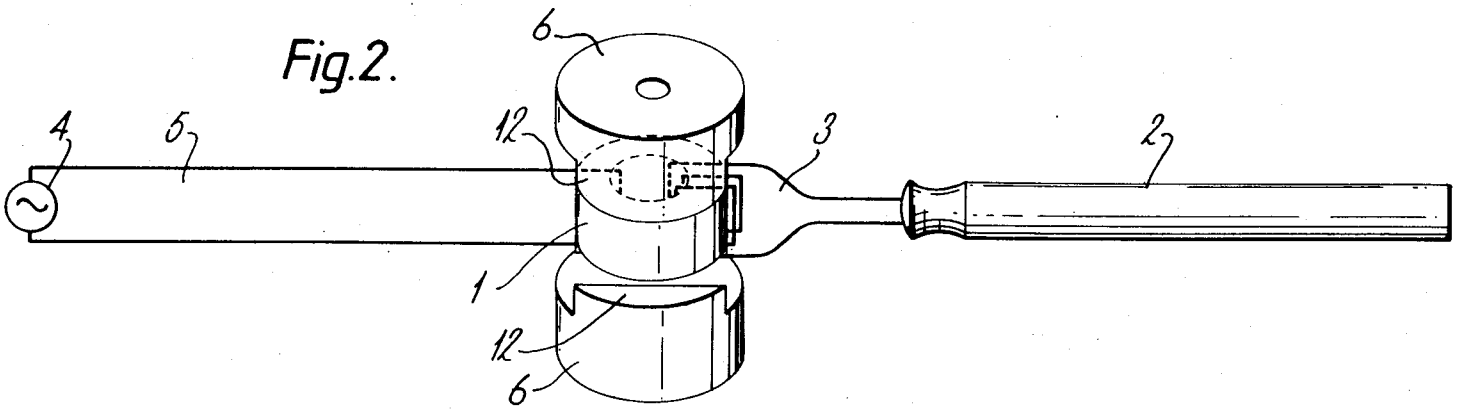
FIG. 2 shows the assembly of FIG. 1 with a magnetic field established within the transformer core.
Figure 3:
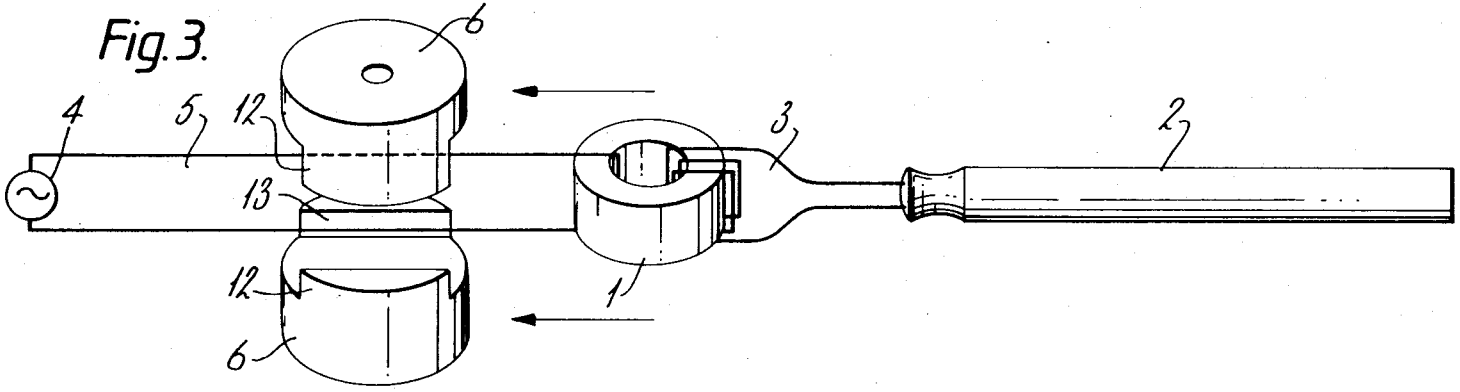
FIG. 3 shows the assembly of FIG. 2 with the magnetic field effectively withdrawn from the transformer core.

In the assembly as shown in FIG. 2 two permanent magnets 6 are positioned respectively on opposite sides of the toroid 1 and in close proximity thereto, with both poles (12,13) of each magnet close to the toroid 1. With the magnets 6 in this position the coupling efficiency of the toroid 1 is temporarily reduced so that current supplied by the generator 4 is not transmitted to the detonator 2. The efficiency is most effectively reduced by having the poles of one magnet positioned facing like poles of the other magnet through the toroid. When the detonator 2 is to be fired the magnets 6 are removed from the vicinity of the toroid 1 as shown in FIG. 3, whereupon the coupling efficiency of the toroid 1 is restored to its original value and firing energy may be transmitted from the generator 4 to the detonator 2.

Figure 4:
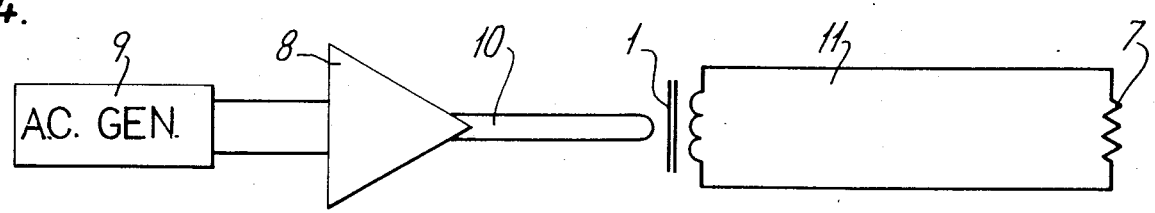
FIG. 4 shows a test circuit diagram for testing the efficiency of a transformer coupling.

The effectiveness of the magnets 6 in reducing the coupling efficiency of a toroid 1 was tested in the circuit arrangement of FIG. 4. In the test circuit a variable frequency A.C. generator 9 was connected to provide input to a power amplifier 8. The A.C. output from the amplifier 8 was fed through a primary circuit 10 coupled to a toroid 1 by a single loop (as in FIG. 1). A secondary circuit 11 coupled to the toroid 1 by three turns of wire (as in FIG. 1) was connected to a resistive load 7 of 1 ohm, which corresponds approximately with the resistance of the ignition element in the electric detonator 2.

The following Table gives the secondary circuit currents measured at different frequences for a primary circuit of 6 amps using (a) no magnet (as in FIG. 1), (b) one magnet, and (c) two magnets (as in FIG. 2) positioned close to the toroid 1. The magnets were "Eclipse" E852 "Maxi Magnets" having a closed circuit flux density of approximately 630 gauss.

Figure 5:
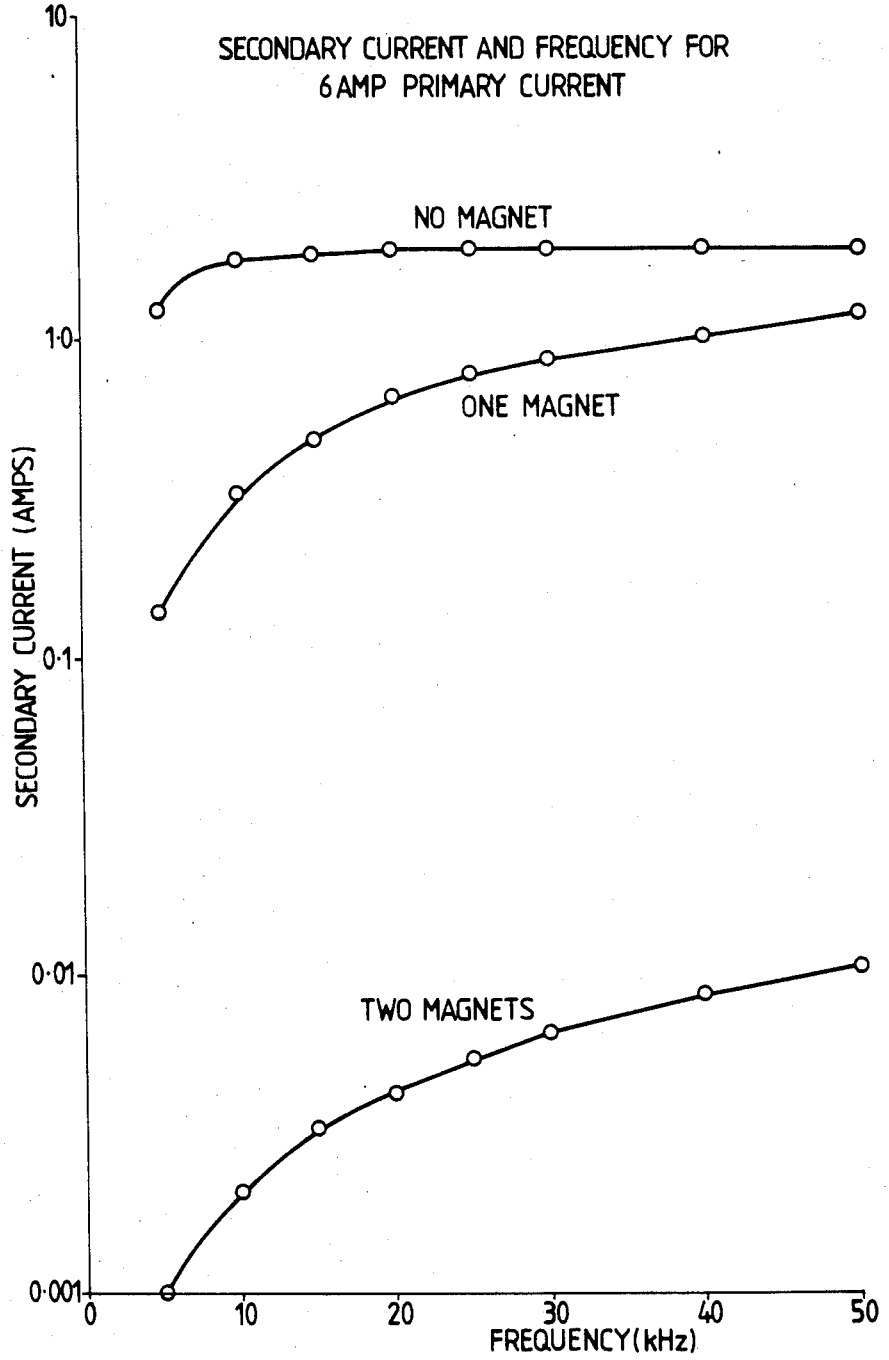
FIG. 5 shows graphs of the secondary circuit current with various magnetic field intensities within the core of the inductive coupling device of the assembly of FIG. 1.

The observations given in the Table are shown graphically in FIG. 5. These results show that over the frequency range 5 to 50 kHz the secondary current can be substantially reduced by the magnets. Thus the transmission of sufficient energy to fire an inductively coupled detonator, which usually requires a minimum firing current of about 1 amp., can be readily prevented by the application of a steady magnetic field within the core of the inductive coupling.

TABLE

| | SECONDARY CURRENT (AMPS) | | |
|---|---|---|---|
| Frequency kHz | No Magnets | One Magnet | Two Magnets |
| 5 | 1.23 | 0.14 | 0.0009 |
| 10 | 1.77 | 0.33 | 0.0002 |
| 15 | 1.85 | 0.48 | 0.0033 |
| 20 | 1.90 | 0.66 | 0.0042 |
| 25 | 1.90 | 0.77 | 0.0055 |
| 30 | 1.90 | 0.87 | 0.0066 |
| 40 | 1.90 | 1.02 | 0.0088 |
| 50 | 1.91 | 1.23 | 0.0108 |

I claim:

1. An assembly for firing an electric ignition element comprising:

a transformer having a magnetically permeable core, a primary circuit adapted to be connected to a source of A.C. energy and a secondary circuit;

an ignition element connected to said secondary circuit; and means for selectively applying a steady magnetic field within at least a portion of said core, the intensity of said steady magnetic field within said core being sufficiently strong to prevent effective transmission of electrical energy from said primary circuit to said secondary circuit the passage of electrical energy from said primary circuit to said secondary circuit being enabled when said applying means does not apply said steady magnetic field.

2. An assembly as claimed in claim 1 wherein said applying means comprises at least one magnet.

3. An assembly as claimed in claim 2 wherein said magnet is movable with respect to the core so that the magnetic field intensity can be varied by relative movement of the magnet and core.

4. An assembly as claimed in claim 2 wherein said magnet is a permanent magnet.

5. An assembly as claimed in claim 4 wherein said permanent magnet has its poles disposed so that they may both simultaneously be in close proximity to the magnetically permeable core.

6. An assembly as claimed in claim 1 wherein said applying means is capable of magnetically saturating the magnetically permeable core.

7. An assembly as claimed in claim 1 wherein the magnetically permeable core is a ferrite core.

8. An assembly as claimed in claim 1 wherein the core is a ring core.

9. An assembly as claimed in claim 8 wherein at least one of said circuits may be coupled as a winding of at least one turn through said ring core.

10. A method of firing an electric ignition element comprising the steps of:

applying a steady magnetic field within at least a portion of a magnetically permeable core of a transformer having a secondary circuit connected to an electric ignition element and a primary circuit;

decreasing said steady magnetic field to allow energy to be transferred between said primary circuit and said secondary circuit; and applying an A.C. signal to said primary circuit of said transformer to fire said ignition element, said steady magnetic field applied during said applying step being of sufficient intensity to suppress the transfer of energy between said primary circuit and said secondary circuit.

11. A method is claimed in claim 10 wherein the steady magnetic field is applied by a magnet which is movable with respect to the core from a position in which the core lies within the steady magnetic field of said magnet to a position in which the core is effectively outside said steady magnetic field.

12. A method of arming an electric ignition element comprising the steps of:

applying a steady magnetic field within at least a portion of a magnetically permeable core of a transformer having a primary circuit and a secondary circuit connected to an electric ignition element, said steady magnetic field being of sufficient intensity to suppress a transfer of energy between said primary circuit of said transformer and said secondary circuit to maintain said ignition element in a safe condition; and reducing said steady magnetic field to permit the transmission of firing energy between said primary circuit and said secondary circuit to said ignition element to arm said ignition element.

* * * * *